US005106122A

United States Patent [19]

Perelman

[11] Patent Number: 5,106,122

[45] Date of Patent: Apr. 21, 1992

[54] COMBINED CALENDAR AND CATALOG

[76] Inventor: Brad S. Perelman, 5815 Northumberland St., Pittsburgh, Pa. 15217

[21] Appl. No.: 672,950

[22] Filed: Mar. 21, 1991

[51] Int. Cl.[5] ..... B42D 5/04

[52] U.S. Cl. ..... 283/2; 40/107

[58] Field of Search ..... 283/2, 3, 4; 40/107, 40/121

[56] References Cited

U.S. PATENT DOCUMENTS

| | | | |
|---|---|---|---|
| 256,316 | 4/1882 | Green | 283/2 |
| 444,150 | 1/1891 | Haworth | 283/2 |
| 1,536,429 | 5/1925 | Ferdon | 283/2 |
| 1,559,247 | 10/1925 | Graton | 283/2 |
| 2,172,665 | 9/1939 | Matysik | 283/2 |
| 4,043,573 | 8/1977 | Griffin | 283/2 |

FOREIGN PATENT DOCUMENTS

| | | | |
|---|---|---|---|
| 453606 | 12/1948 | Canada | 283/2 |

*Primary Examiner*—Joseph M. Gorski
*Assistant Examiner*—Peter Dungba Vo
*Attorney, Agent, or Firm*—Webb, Burden, Ziesenheim & Webb

[57] ABSTRACT

A combined calendar and catalog for providing information about products is disclosed. A calendar portion has a plurality of calendar sheets and a catalog portion has a plurality of catalog sheets. One or more references are located on at least one of the catalog sheets, with each reference denoting a distinct location in the catalog portion. The references may include extended tabs or color coding. Calendar indicia, located on at least one of the calendar sheets, direct a reader to at least one of the references in the catalog portion for product information. The calendar sheets may display one month, one week or one day.

18 Claims, 3 Drawing Sheets

COMBINED CALENDAR AND CATALOG

BACKGROUND OF THE INVENTION

1. Field of the Invention

This invention relates to calendars and, more particularly, to calendars which are combined with other items to provide information in addition to calendar dates.

2. Description of the Prior Art

It is generally known in the art to combine calendars with other items which contain information in addition to calendar dates. U.S. Pat. No. 467,283 to Sittig discloses a calendar having monthly calendar sheets of successively greater length, with indicia on the exposed margin of each calendar sheet to identify a particular alcoholic beverage. The overleaf of each calendar sheet reveals price information about the alcoholic beverage indicated on the exposed margin of that calendar sheet.

U.S. Pat. No. 1,376,198 to Goldstone discloses a buyer's guide which includes a plurality of tabbed sheets in a ringed binder. Each tab denotes a portion of the buyer's guide dedicated to a specific product which is identified by indicia on the tab. The individual sheets of the buyer's guide contain product information and prices, as well as the date upon which the information and prices are effective.

U.S. Pat. No. 2,282,630 to Winford discloses a book reference calendar wherein a reference book is combined with a detachable monthly calendar.

Various other calendar combinations are disclosed by U.S. Pat. Nos. 1,442,390; 3,964,195; and 4,757,624. None of these references provide a calendar bound together with a catalog, with indicia on the calendar which direct a reader to a distinct location in the catalog for information about products.

Therefore, an object of the present invention is to provide a combined calendar and catalog which has a catalog portion that is readily referred to from the face or header of the calendar sheets. A further object of the invention is to correlate information about products with dates displayed by an attached calendar. A still further object of the invention is to combine a calendar with a catalog in a convenient, singly bound form for ready location of information, such as product descriptions and prices.

SUMMARY OF THE INVENTION

Accordingly, I have developed a combined calendar and catalog for providing information about various products. A calendar portion has a plurality of calendar sheets which chronologically display certain calendar dates. A catalog portion has a plurality of catalog sheets which display product information. Attachment means are provided for binding the calendar portion together with the catalog portion. One or more references are located on at least one of the catalog sheets, with each reference denoting a distinct location in the catalog portion. Calendar indicia are located on at least one of the calendar sheets. The calendar indicia direct a reader to at least one of the references in the catalog portion where information about products may be found.

One embodiment of the invention includes a plurality of monthly calendar sheets with the catalog portion bound at the back of the calendar portion by staples. A plurality of extended tabs are located on the catalog portion, with each tab extending from one of the catalog sheets. The calendar indicia direct a reader to at least one of the tabs on the catalog portion. The tab identifies a distinct location in the catalog portion where information about products may be found. The calendar indicia may be located on the face of the calendar sheet or on the header of the calendar sheet.

Another embodiment of the invention includes a plurality of weekly calendar sheets with the catalog portion bound at the back of the calendar portion in a ringed binder. The catalog portion has a plurality of sections, and each successive section has catalog sheets of greater length. The margin of each section is exposed to view from the face of the calendar sheets. A reference is located on each exposed margin to denote a distinct location in the catalog portion. Calendar indicia, located on at least one of the calendar sheets, direct a reader to at least one of the references on the catalog portion where information about products may be found. The margin of each section may include color coding as the references, and the calendar indicia may be located on the face of the calendar sheet.

Another embodiment of the invention includes a rigid backing upon which the calendar portion and the catalog portion are mounted adjacent to one another. A plurality of tabs are located on the catalog portion, and each tab extends from one of the calendar sheets. Each tab includes tab indicia for identifying dates for which the products found in the catalog portion are appropriate.

DETAILED DESCRIPTION OF THE PREFERRED EMBODIMENTS

Figure 1:
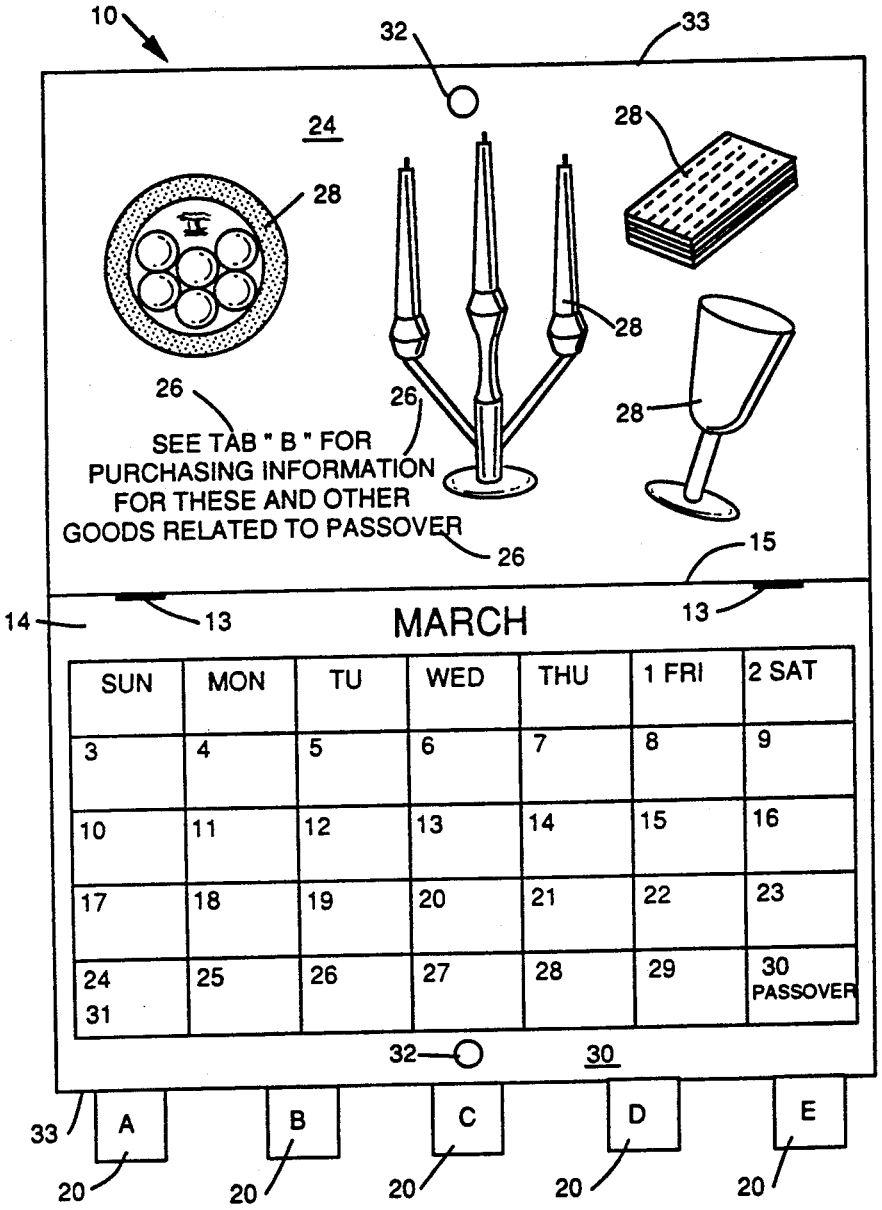
FIG. 1 is a front view of a first embodiment of a combined calendar and catalog in accordance with the present invention.
Figure 2:
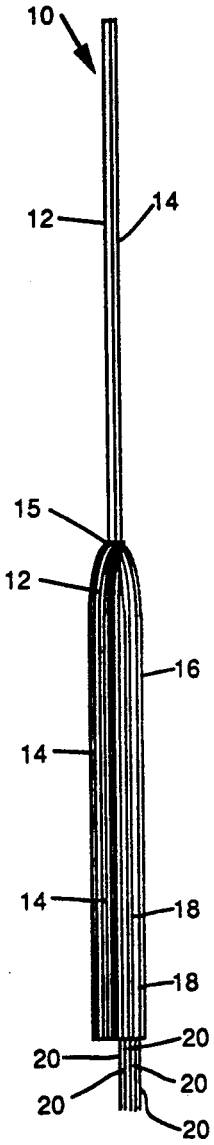
FIG. 2 is a side view of the combined calendar and catalog of FIG. 1.

FIGS. 1 and 2 show a combined calendar and catalog 10 in accordance with a first embodiment of the present invention. The combined calendar and catalog 10 has a calendar portion 12 which has a plurality of monthly calendar sheets 14. A catalog portion 16 is bound together with the calendar portion 12 at the back of the calendar portion 12. The calendar portion 12 and the catalog portion 16 are attached by a plurality of staples 13 located in a seam 15. The catalog portion 16 has a plurality of catalog sheets 18 which display product information. A plurality of extended tabs 20 are located on the catalog portion 16, and each tab 20 extends from one of the catalog sheets 18 to denote a distinct location in the catalog portion 16.

Calendar indicia 26 are located on a header 24 of the monthly calendar sheet 14 facing the reader. The calendar indicia 26 explicitly direct a reader to tab "B" on the catalog portion 16 for information about products appropriate for Passover, which falls near the end of the month displayed by the monthly calendar sheet 14. The header 24 can also contain a plurality of illustrations 28 of the products which would be found at the location in the catalog portion 16 denoted by tab "B". The illustrations 28 and the calendar indicia 26 may also be located on a face 30 of the monthly calendar sheets 14 and the header 24 may be utilized for displaying various items in addition to product illustrations 28. For example, the header 24 may include text, such as for recipes, landscape scenes, or scenes depicting daily life. The scenes may include drawings or photographs. The calendar portion 12 also includes an aperture 32 near an outer edge 33 of each calendar sheet 14 for hanging the combined calendar and catalog 10 on a wall or the like.

Figure 3:
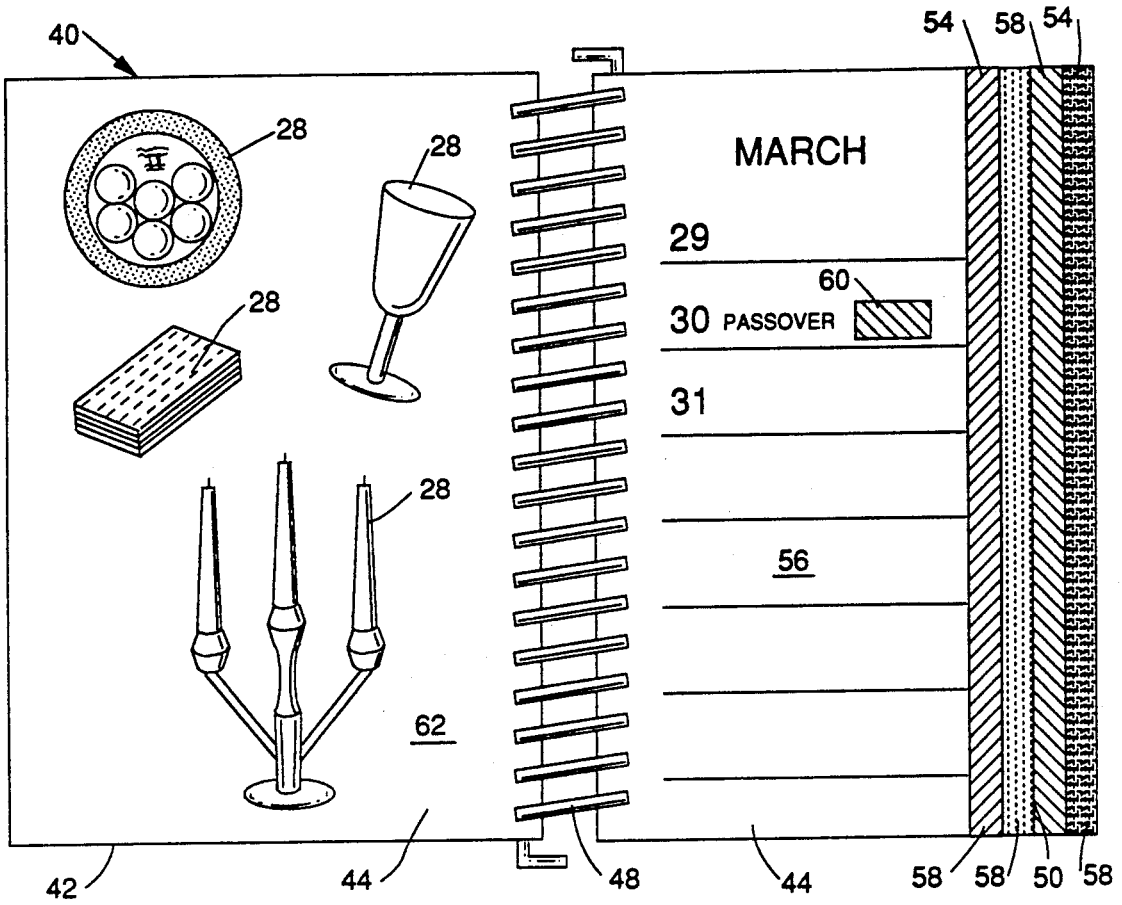
FIG. 3 is a front view of a second embodiment of a combined calendar and catalog in accordance with the present invention.
Figure 4:
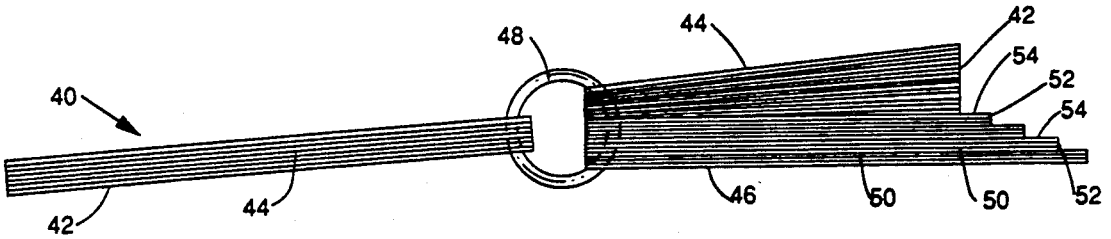
FIG. 4 is an end view of the combined calendar and catalog of FIG. 3.

A second embodiment of the combined calendar and catalog 40 is shown in FIGS. 3 and 4. The combined calendar and catalog 40 has a calendar portion 42 which has a plurality of weekly calendar sheets 44 displaying seven calendar days. The calendar portion 42 is bound together with a catalog portion 46 in a ringed binder 48. The catalog portion 46 is located at the back of the calendar portion 42 and has a plurality of catalog sheets 50 which display product information. The catalog portion 46 has a plurality of sections 52, with each successive section having catalog sheets 50 of greater length. The margin 54 of each section is exposed to view from a face 56 of the weekly calendar sheets 44.

A reference 58 is located on each margin 54 to denote a distinct location in the catalog portion 46. Additionally, calendar indicia 60 are located on the face 56 of the weekly calendar sheet 44. The calendar indicia 60 direct a reader to at least one of the references 58 on the catalog portion 46 for information about products appropriate for the dates indicated by the weekly calendar sheet 44. Preferably, the calendar indicia 60 and the references 58 include color coding as shown in FIG. 3. Other suitable references 58 and calendar indicia 60 include icons and printed matter.

An overleaf 62 of each weekly calendar sheet 44 may include illustrations 28 of the products found in the location of the catalog portion 46 to which the reader is referred. The calendar indicia 60 may also be located on the overleaf 62, and the illustrations 28 may likewise be located on the face 56 of the weekly calendar sheet 44. As with the header in the first embodiment above, the overleaf 62 may display items in addition to the illustrations 28.

Figure 5:
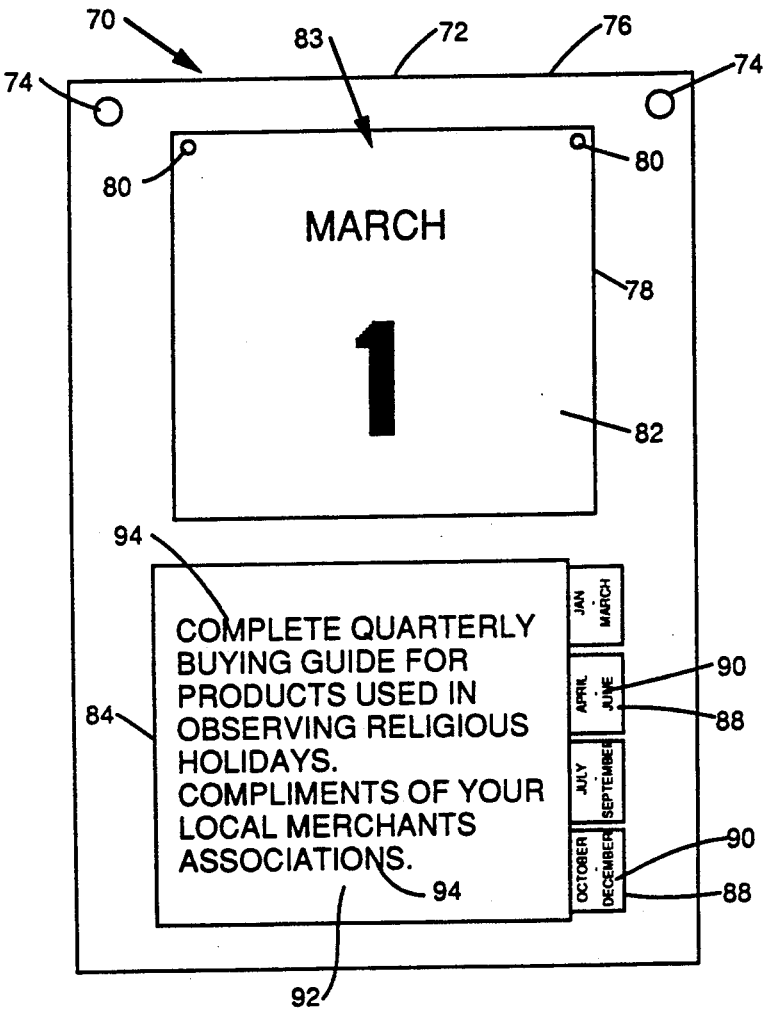
FIG. 5 is a front view of a third embodiment of a combined calendar and catalog in accordance with the present invention.
Figure 6:
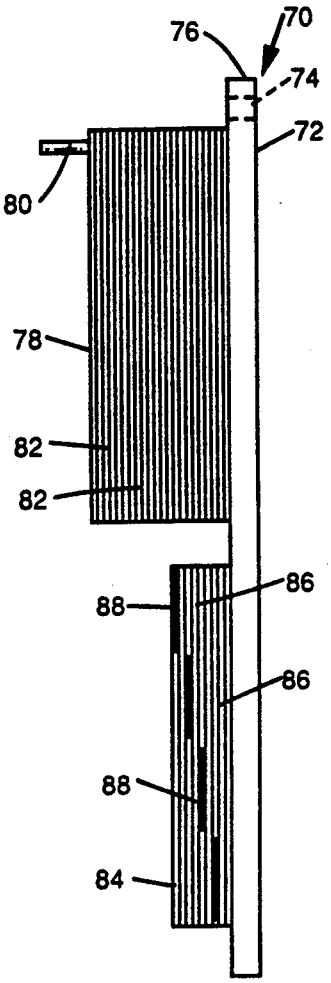
FIG. 6 is a side view of the combined calendar and catalog of FIG. 5.

A third embodiment of the combined calendar and catalog 70 is shown in FIGS. 5 and 6. The combined calendar and catalog 70 has a flat, rigid backing 72, such as a sheet of cardboard, plastic or wood, with two apertures 74 along an upper edge 76 of the rigid backing 72. The apertures 74 may be used to mount the rigid backing 72 to a wall or the like. A calendar portion 78 is mounted on the upper half of the rigid backing 72 and is secured by a pair of posts 80. Alternatively, the calendar portion 78 may be glued or stapled to the rigid backing 72. The calendar portion 78 includes a plurality of daily calendar sheets 82 which may be torn from the posts 80 as the calendar year progresses. The calendar sheets 82 include calendar indicia 83 which identify the date and any corresponding holiday or seasonal event.

A catalog portion 84 is mounted on the lower half of the rigid backing 72 adjacent to the calendar portion 78. The catalog portion 84 may be permanently or removably mounted to the rigid backing 72 by means of glue, staples, a slotted sleeve or otherwise. The catalog portion 84 has a plurality of catalog sheets 86 which display product information. A plurality of tabs 88 are located on the catalog portion 84, and each tab 88 extends from one of the catalog sheets 86 to denote a distinct location in the catalog portion 84.

A cover sheet 92 of the catalog portion 84 includes printed matter 94 which identifies the catalog portion 84 as well as its source. The catalog portion 84 is divided by tabs 88 into four sections, each tab 88 having tab indicia 90 which identify one quarter of the calendar year. The products found at the location identified by each tab 88 are appropriate for the quarter indicated by that tab's indicia 90. Thus, the calendar indicia 83 automatically refer a reader to the appropriate tab 88 on the catalog portion 84 for product information.

Referring back to FIGS. 1 and 2, proper use of the combined calendar and catalog 10 will now be explained. The combined calendar and catalog 10 may be wall mounted using the aperture 32 near the outer edge 33 of the calendar portion 12. The monthly calendar sheets 14 are paged until the face 30 of the appropriate monthly calendar sheet 14, and its corresponding header 24, are displayed. FIG. 1 shows the combined calendar and catalog 10 displaying the month of March. The monthly calendar sheet 14 indicates that Passover, a religious holiday, falls on the thirtieth day of March. Correspondingly, the illustrations 28 on the header 24 show products appropriate for the particular observances related to Passover.

After identifying the products shown in the illustrations 28 on the header 24, the reader observes the calendar indicia 26 which direct the reader to the tab 20 identified as "B" The reader then thumbs tab "B" and folds over all sheets intervening between tab "B" and the monthly calendar sheet 14 which displays the month of March. The reader is then at a location in the catalog portion 12 which contains product information for goods relating to Passover. Such product information might include prices, availability, product identification numbers, minimum lots, and so on. Once the appropriate information has been obtained, the sheets intervening between tab "B" and the monthly calendar sheet 14, which displays the month of March, are folded back to their original position, and the calendar portion 12 is again displayed.

Similarly, the weekly calendar sheets 44 of the second embodiment of the combined calendar and catalog 40 are paged to display the appropriate date. Holidays and events are indicated next to their particular date on the weekly calendar sheets 44, such as Passover on March 30th. The calendar indicia 60 on the face 56 of the weekly calendar sheet 44 also correspond to the Passover date. The reader identifies the calendar indicia 60, such as color coding, and this color is matched with the appropriate color on the exposed margin 54 of the catalog portion 46. The reader then thumbs the matched margin 54 and folds over all sheets intervening between that catalog sheet 50 and the weekly calendar sheet 44 which displays Passover. The reader is then positioned in the catalog portion 46 at a distinct section 52 which contains information about products relating to Passover.

For the third embodiment of the combined calendar and catalog 70, each successive daily calendar sheet 82 is ripped from the posts 80, which secure the calendar portion 78 to the rigid backing 72. The calendar indicia 83 on the daily calendar sheets 82 indicate current or upcoming holidays. Noting the month which the calendar indicia 83 displays, the reader thumbs the appropriate tab 88, whose tab indicia 90 indicate the quarter of the year which contains that month. The sheets between the cover sheet 92 and the thumbed tab 88 are then folded over. Thus, the reader is positioned in the catalog portion 84 at a location containing product information relating to goods appropriate for the event or holiday indicated by the daily calendar sheet 82.

Having described the presently preferred embodiments, it is to be understood that the invention may be otherwise embodied within the scope of the appended claims.

I claim:

1. A combined calendar and catalog for providing purchasing information about products, comprising:

a calendar portion having a plurality of calendar sheets which chronologically display calendar dates;

a catalog portion having a plurality of catalog sheets which display product information;

one or more references on at least one of said catalog sheets, with each reference denoting a distinct location in said catalog portion;

attachment means for binding said calendar portion together with said catalog portion; and calendar indicia printed on at least one of said calendar sheets which relate specific parts of said calendar portion with a specific one of said references by directing a reader to a predetermined specific one of said references in said catalog portion where information about products may be found.

2. The combined calendar and catalog of claim 1 wherein said references include at least one tab extending from at least one of said catalog sheets to denote a distinct location in said catalog portion, with each tab having tab indicia thereon for identifying said tab.

3. The combined calendar and catalog of claim 1 wherein said catalog portion has a plurality of sections and each successive section has catalog sheets of greater length, with the margin of each section being exposed to view from the face of said calendar sheets, and with one of said references located on each exposed margin to denote a distinct location in said catalog portion.

4. The combined calendar and catalog of claim 3 wherein said catalog portion includes color coding on said exposed margins as said references for said catalog sheets.

5. The combined calendar and catalog of claim 4 wherein said calendar indicia includes color coding.

6. The combined calendar and catalog of claim 1 wherein said attachment means includes a plurality of staples.

7. The combined calendar and catalog of claim 1 wherein said attachment means includes a ringed binder.

8. The combined calendar and catalog of claim 1 wherein said attachment means includes a rigid backing upon which said calendar portion and said catalog portion are mounted.

9. The combined calendar and catalog of claim 1 wherein each calendar sheet displays one calendar month.

10. The combined calendar and catalog of claim 1 wherein each calendar sheet displays seven calendar days.

11. The combined calendar and catalog of claim 1 wherein each calendar sheet displays one calendar day.

12. The combined catalog and calendar of claim 1 wherein said catalog portion includes illustrations of products and wherein said calendar indicia direct a reader to a specific predetermined one of said references in said catalog where information about said illustrated products may be found.

13. A combined calendar and catalog for providing information about products, comprising:

a calendar portion having a plurality of monthly calendar sheets;

a catalog portion bound together with said calendar portion at the back of said calendar portion, said catalog portion having a plurality of catalog sheets which display product information;

a plurality of extended tabs on said catalog portion, with each tab extending from one of said catalog sheets to denote a distinct location in said catalog portion; and calendar indicia printed on at least one of said monthly calendar sheets which relate specific parts of said calendar portion with a specific one of said references by directing a reader to a predetermined specific one of said tabs on said catalog portion where information about products may be found.

14. The combined calendar and catalog of claim 13 wherein said calendar indicia is located on the face of said monthly calendar sheet.

15. The combined calendar and catalog of claim 13 wherein said calendar indicia is located on the header of said monthly calendar sheet.

16. A combined calendar and catalog for providing information about products, comprising:

a calendar portion having a plurality of weekly calendar sheets;

a catalog portion bound together with said calendar portion at the back of said calendar portion, said catalog portion having a plurality of catalog sheets which display product information;

a plurality of sections within said catalog portion, with each successive section having catalog sheets of greater length and with the margin of each section being exposed to view from the face of said weekly calendar sheets, and further with a reference located on each exposed margin to denote a distinct location in said catalog portion; and calendar indicia printed on at least one of said weekly calendar sheets which relate specific parts of said calendar portion with a specific one of said references by directing a reader to a predetermined specific one of said references on said catalog portion where information about products may be found.

17. The combined calendar and catalog of claim 16 wherein said margins include color coding as said references.

18. The combined calendar and catalog of claim 16 wherein said calendar indicia are located on the face of said weekly calendar sheet.

* * * * *

UNITED STATES PATENT AND TRADEMARK OFFICE

CERTIFICATE OF CORRECTION

PATENT NO. : 5,106,122

DATED : April 21, 1992

INVENTOR(S) : Brad S. Perelman

It is certified that error appears in the above-identified patent and that said Letters Patent is hereby corrected as shown below:

Title page, item [56], References Cited, insert:

--467,283 1/1892 Sittig
1,376,198 4/1921 Goldstone
1,442,390 1/1923 Farmer
2,282,630 5/1942 Winford ... 283/4
3,964,195 6/1976 Jordan ... 40/107
4,757,624 7/1988 Holec ... 40/119
4,822,052 4/1989 Dimmick et al. ... 273/162--.

Column 4 Line 31 ""B" The" should read --"B". The--.

Signed and Sealed this

Twenty-second Day of June, 1993

*Attest:*

Michael K. Kirk

MICHAEL K. KIRK

*Attesting Officer*

*Acting Commissioner of Patents and Trademarks*